US005156537A

United States Patent [19]

Massinon

[11] Patent Number: 5,156,537

[45] Date of Patent: Oct. 20, 1992

[54] MULTIPHASE FLUID MASS TRANSFER PUMP

[75] Inventor: Roland M. J. Massinon, Estevan, Canada

[73] Assignee: Exxon Production Research Company, Houston, Tex.

[21] Appl. No.: 780,586

[22] Filed: Oct. 22, 1991

Related U.S. Application Data

[62] Division of Ser. No. 519,368, May 4, 1990.

[30] Foreign Application Priority Data

May 5, 1989 [CA] Canada ..... 598891

[51] Int. Cl.[5] ..... F04B 21/02; F04B 39/10

[52] U.S. Cl. ..... 417/536

[58] Field of Search ..... 417/536, 540, 900; 60/413, 416

[56] References Cited

U.S. PATENT DOCUMENTS

| | | | |
|---|---|---|---|
| 205,052 | 6/1878 | Carr | 417/536 |
| 2,962,975 | 12/1960 | Camp | 417/536 |
| 3,081,934 | 3/1963 | Abernathy et al. | 417/536 |
| 3,542,493 | 1/1969 | Alderson | 417/536 |
| 3,990,816 | 11/1976 | Kohler et al. | 417/536 |
| 5,076,769 | 12/1991 | Shao | 417/536 |

*Primary Examiner*—Richard A. Bertsch

*Assistant Examiner*—Alfred Basichas

*Attorney, Agent, or Firm*—Darcell Walker

[57] ABSTRACT

A positive displacement piston pump that can pump multiphase fluids by separating the fluid into its different components inside the pump before pumping the fluids. A reciprocating piston mounted inside the pump barrel divides the barrel into two chambers, with each chamber having an opening. Accumulators located above the chambers and below the pump inlet provide a space for the multiphase fluids entering the pump to separate before entering the chamber. As the multiphase enters each accumulator, gravity causes the liquid to sink and the gas to rise separating the different phases, preferably allowing liquid to enter the chambers before the gas. When the piston moves through the chambers forcing the fluid through outlet valves located on the top side of the chamber the gas will exit the chamber, the accumulator, and the pump before the liquids. The piston moves through the pump barrel in one direction causing the chamber in that direction to decrease in volume thereby forcing the multiphase fluid in that chamber out through an outlet valve and into the pipeline. Simultaneously, fluid from the source pipeline is drawn into the other chamber comprised of the part of the pump barrel in a direction opposite the movement of the piston.

2 Claims, 6 Drawing Sheets

MULTIPHASE FLUID MASS TRANSFER PUMP

This application is a divisional of co-pending application Ser. No. 07/519,368, filed May 4, 1990.

FIELD OF THE INVENTION

This invention relates to a method and apparatus for pumping multiphase fluid. In particular it relates to pumping multiphase fluid by positive displacement without separating the multiphase fluid into its various phases prior to introducing the fluid into the pump.

BACKGROUND OF THE INVENTION

As used herein, multiphase fluid means a fluid composed of both liquid and gas phases and which may also contain solid particles.

The major challenge of pumping multiphase fluids is to pump the fluid through a flowline under a wide range of conditions. As used herein, flowline includes flowlines from producing wells, as well as any other conduit such as pipeline or vessel. Single phase pumps and compressors are designed to pump only fluids of constant density, or single phase. When more than one fluid phase is present, such as gas and liquid, the fluid densities vary drastically. The constantly varying densities combined with the high speed of the moving components in the pumping equipment generate changing and unbalanced forces that the single phase pump and compressor are not designed to handle.

Currently, the most widely used method of pumping a multiphase fluid is to separate the fluid into its various components upstream of the pump; then pumping these components with separate pumps through separate flowlines. This approach allows the existing equipment to continue to pump single phase fluids. However, this separation method and separate pumping is expensive and may require elaborate equipment.

Multiphase pumps make it possible to directly pump multiphase fluids through pipelines, thereby eliminating the need to separate the fluid into discrete phases before pumping. Two types of pumps, rotodynamic and positive displacement pumps, are known for multiphase pumping. Rotodynamic pumps, which include centrifugal and axial turbine types, are well-suited to low pressures. However, rotodynamic pumps have great difficulty pumping multiphase fluids containing even a small percentage, say 2% to 4%, of gas phase (as opposed to dissolved gas).

Positive displacement pumps can more easily pump gas/liquid mixtures so they are more suitable to pump fluids with higher gas fractions. They can also achieve high discharge pressures. However, a drawback of positive displacement pumps is that they work with small clearances and therefore are more susceptible to sand damage and erosion. Most positive displacement pumps are screw type pumps. An elongated screw is housed and rotated on a cylindrical barrel. As the screw rotates, it pulls in fluid from a first end of the barrel and ejects it under pressure from the other end.

In the April 1988 issue of *Offshore* magazine, an article entitled "The WST-Pump, A Reciprocating Rotary Ram Pump for Multiphase Boosting" disclosed a pump/compressor that pumps multiphase fluids using a piston type pump. The WST-Pump employs an annular array of multiple cylinders that rotate around an axis as pistons on the cylinders alternately intake and discharge multiphase fluid.

SUMMARY OF THE INVENTION

This invention provides an apparatus and method for pumping multiphase fluids through a flowline. The pump of the invention is adapted to pump multiphase fluids by separating the fluid in the pump, whereby the piston preferably only contacts the liquid phases of the fluid. In the preferred embodiment, the pump is a double acting design. A piston in a longitudinal bore defines a pump chamber on either side of the piston. An accumulator is connected to the pump housing between the inlet and outlet valves and each chamber. These accumulators are preferably elevated relative to the pump housing and the openings through the housing. The accumulators provide a volume directly over the chamber of the pump where the multiphase fluid that enters the pump can separate into its components. When the fluid enters the accumulator, gravity causes the liquids to fall while the gases rise. Because of the separation, the piston is more likely to contact only the liquid phase and less likely to contact gases. This increases the pump efficiency by reducing slippage as a result of contact with gas.

In another embodiment, a piston inside the housing defines a single chamber in fluid communication with a source of multiphase fluid and a flowline. The volume of the chamber varies with the movement of the piston. The piston reciprocates in the housing from the inlet end to the outlet end, forcing multiphase fluid out of the chamber through an outlet check valve and into the flowline. The piston has openings through it and a check valve so that fluid that has entered the housing behind the piston will flow through the piston on the return stroke.

In the method of the invention fluid is introduced into a pump, then permitted to separate as a result of gravity forces before pumping the fluid through a flowline.

DESCRIPTION OF THE PREFERRED EMBODIMENT

Figure 1:
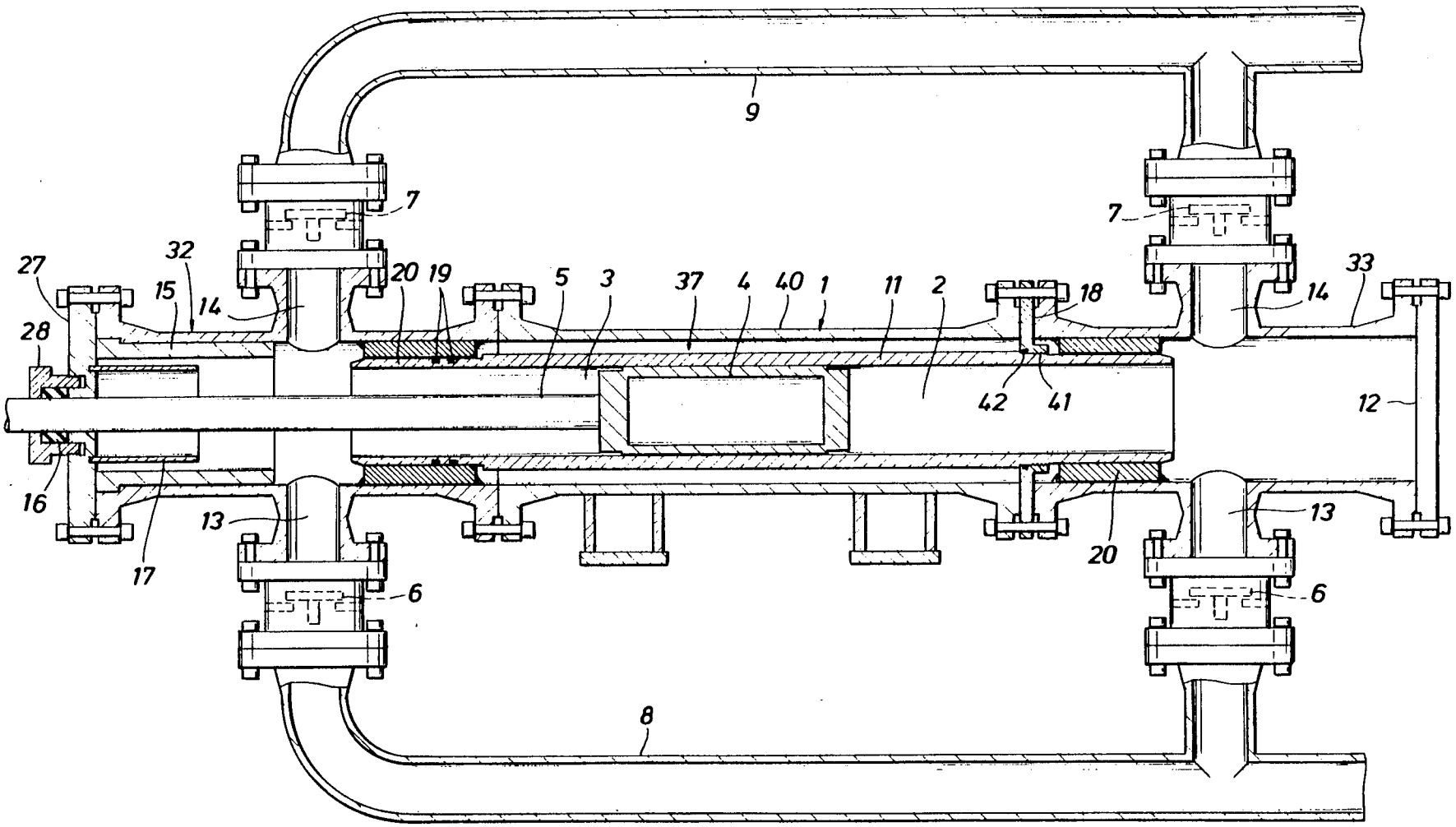
FIG. 1 is a detailed cross-sectional view of an embodiment of the pump of the present invention.
Figure 3:
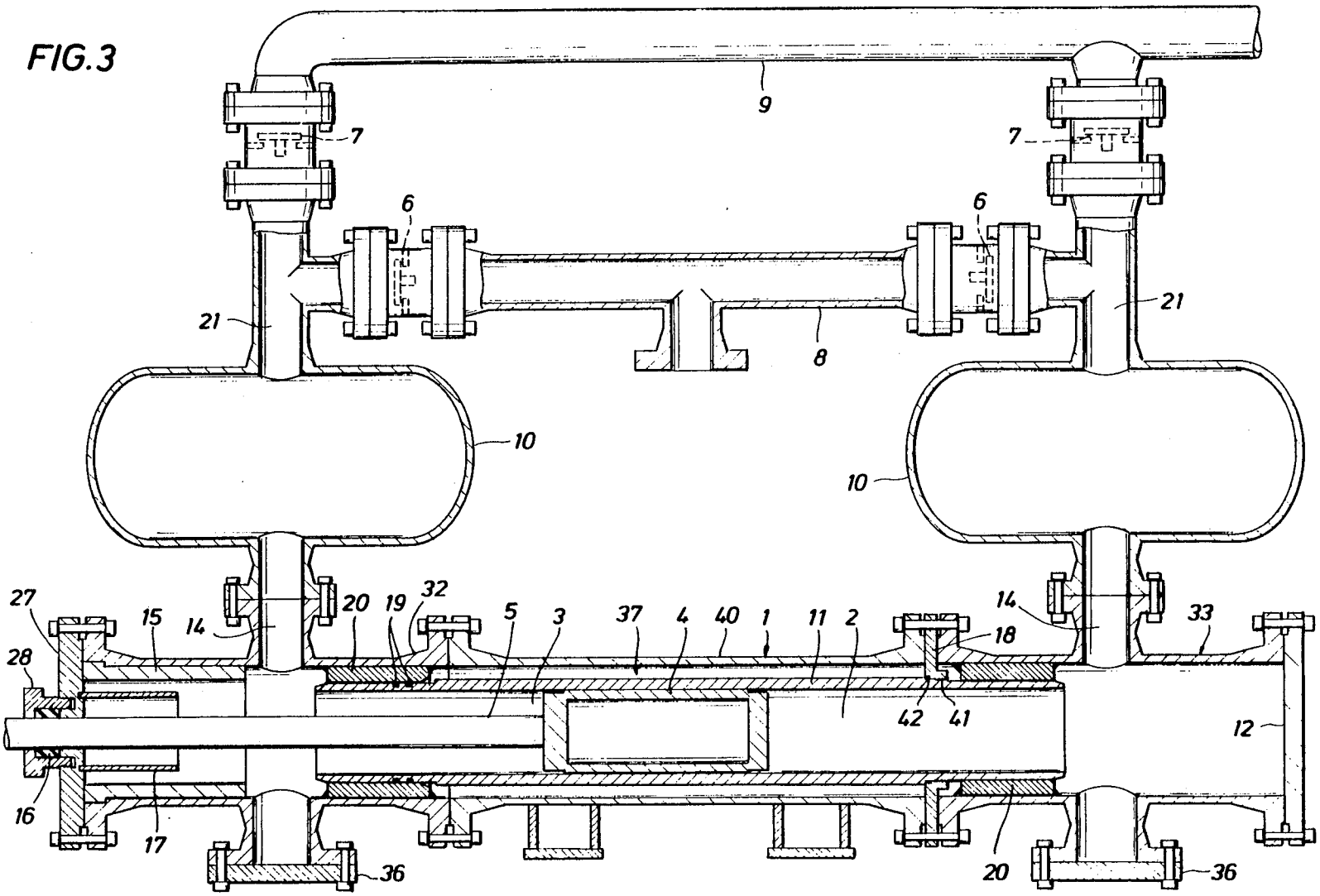
FIG. 3 is a cross-sectional view of the preferred embodiment of the present invention incorporating accumulators.

The preferred embodiment of the apparatus of the invention is shown in FIG. 3. However, the alternate embodiment of the pump illustrated in FIG. 1 will be discussed first in order to illustrate the general operation of the apparatus of the invention. The pump includes a generally horizontally disposed housing 1 having a longitudinal bore 2 therethrough open at each end. The housing 1 also has openings 13 on the lower side thereof; and openings 14 on the upperside of the housing 1 at each end. The housing preferably comprises a steel cylinder having a diameter large enough to contain a steel barrel 11 that has smaller diameter and is mounted inside the housing as shown in FIG. 1. Because the housing and barrel have different diameters, an annular space 37 exists between them. Because of this space, the barrel and housing must be aligned. Annular spacer 20 is preferably a metal ring, and may be made of the appropriate size and schedule pipe, mounted between the housing 1 and the barrel 11. This annular spacer is preferably welded to the inner wall of the housing 1 to prevent leakage around the outside diameter of the spacer 20. Another annular spacer 20 is welded to the inner wall of the housing at the other end of the housing. O-rings 19 are used to seal the annular space from any fluid leakage between the inlet and the outlet of the pump. The housing is preferably comprised of three generally cylindrical sections, a center section 40 and two end sections 32 and 33, that are bolted together at flanges 27 and 12 respectively. Suitable gaskets (not shown) are disposed therebetween. The end section 33 of the housing is sealed at its other end by a blind flange 12 and suitable gasket. The opposite end of the housing is sealed by a centering annular adapter 15 welded to an adapter flange 27 which is bolted to the end section 32. The centering annular adapter 15 is welded to the adapter flange 27 and dimensioned to fit into the end housing 32 in a position such that the piston rod will be maintained centrally in the barrel.

Both end sections of the housing are bolted to the center section 40. Between the center section of the housing and the end section 33 is a barrel nut 18. This nut has an "L" shape in cross section and is made of the same material as the blind flange 12. The base of the nut 18 is screwed to the barrel which is appropriately threaded, as indicated at 41, thereby attaching the barrel to the housing. This attachment prevents the barrel from longitudinal movement during pump operation. An O-ring 42 prevents fluid from leaking into the annular space 37 through the nut threads 41.

The housing contains a piston 2 preferably coated with a coating comprising a chromium alloy known to those skilled in the art to increase the hardness of the piston. The piston divides the housing into two chambers, 2 and 3. The piston's diameter is turned down at each end. This is done because the piston 4 preferably contains a void therein to reduce its mass, thus the ends of the piston have more mass than the rest of the piston. During movement of the piston, heat may cause the piston to expand in the barrel. The ends, having more steel, will expand more and may affect the operation of the pump. The smaller diameters reduce the possibility of expansion affecting the operation of the pump. A piston stop 17, made of steel, is attached to the adapter flange by any suitable means to stop the piston motion in the event the drive mechanism moving the piston fails to change the direction of the pistons movement. The piston stop 5 ensures that the piston will not come completely out of the barrel. If the piston comes completely out of the barrel, it could fall out of the barrel and the pump might have to be disassembled in order to reinsert the piston in the barrel. However the piston stop is not an essential element of the pump operation and can be omitted. A piston rod 5 is attached to the piston. The piston rod 5 is driven by a suitable mechanism [not shown] to reciprocate the piston. Suitable mechanisms to reciprocate the piston are well known to persons skilled in the art.

The adapter flange 27 includes a stuffing box 28 and packing 16 for sealing the piston rod. The piston rod 5 passes freely through an opening in the adapter flange 27 and is sealed by packing 16 that surrounds the piston rod and forms a seal between the piston rod and the adapter flange. Stuffing box 28 compresses the packing 16 as is known in the art and may be threaded into the flange 27 or welded thereto. Preferably it is threaded.

A check valve is bolted or otherwise sealingly connected to each of the four openings in the housing. The two inlet check valves 6 below the housing are connected to the housing to only allow fluid to enter the housing. The two inlet valves 6 are in communication with the inlet manifold 8 that is connected to a source of the multiphase fluid. The two outlet check valves 7 above the housing are sealingly connected to the housing to only permit fluid to exit the housing. The two outlet valves are in communication with an outlet manifold 9, which is connected to the flowline into which the fluid is to be pumped. All of the check valves 6, 7, described above are preferably one-way valves spring biased to the closed position, whereby the valve will be urged to the closed position by the spring until a suitable pressure opposing the spring force opens the valve to flow therethrough.

In the preferred embodiment of the invention shown in FIG. 3, accumulators 10 are sealingly mounted to the end sections 32 and 33 of the housing in communication with the openings 14 through the housing. The inlet manifold 8 is sealingly connected to a T fitting 21 above the accumulators. In this embodiment, the openings 13 at the bottom of the end sections 32 and 33 of the housing are sealed off by suitable blind flanges 36. The accumulators 10 are preferably elongated steel vessels having openings in their tops and bottoms. The volume of each accumulator is preferably at least equal to the maximum volume of the chamber 2 not containing the piston rod. The T fitting 21 also connects the inlet 8 and outlet 9 manifolds to the accumulators 10. Inlet check valves 6 are sealingly mounted between the T fitting 21 and the inlet manifold 8 to only allow multiphase fluid to enter the accumulators 10. The outlet check valves 7 are sealingly mounted between the tops of the T fittings 21 and the outlet manifold 9 to only allow fluids to exit the accumulators 10.

Figure 2:
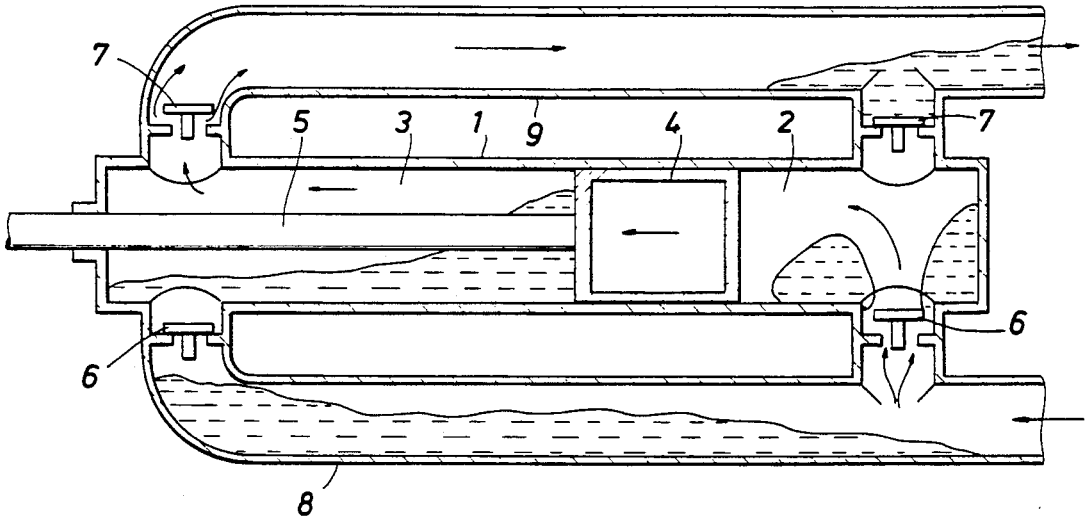
FIG. 2 is a cross-sectional view of the pump of FIG. 1 showing fluid flow through the pump.

In operation of the embodiment of the invention shown in FIG. 2, the piston reciprocates from one end of the housing 1 or barrel 11 to the other. As the piston moves, the volume of the chamber in the direction of the piston movement will decrease, while the volume of the other chamber increases. As a chamber's volume increases, the pressure in that chamber gradually decreases to the suction pressure (the pressure at which fluid can enter the chamber through the inlet check valve) allowing the fluid to enter the chamber. Once the fluid enters that chamber, gravitational forces cause liquids in the fluids to settle downwardly and gases to rise, thereby separating the different components in the fluid. The amount of separation between the fluid components depends on the speed of the piston moving through the housing. Slower piston speeds such as 1.2 meters/second for a chamber 2 having an inner diameter of 8.496 inches and a length of 9 feet and an accumulator preferably at least equal to the maximum volume of the chamber 2 will allow sufficient time for the separation to occur. Different chamber/accumulator volumes and different chamber speeds will obviously affect the separation process. When the piston changes direction and begins to decrease the volume in the chamber containing the separated fluid, the pressure in that chamber will increase above the discharge pressure (pressure at which the discharge check valves open and allow fluid to exit the chamber) forcing the fluid out of the chamber and pump. Slower piston speeds enable the invention to pump liquids without the "water hammer" effect which occurs when a piston reciprocating at a high speed encounters liquid.

Figure 4:
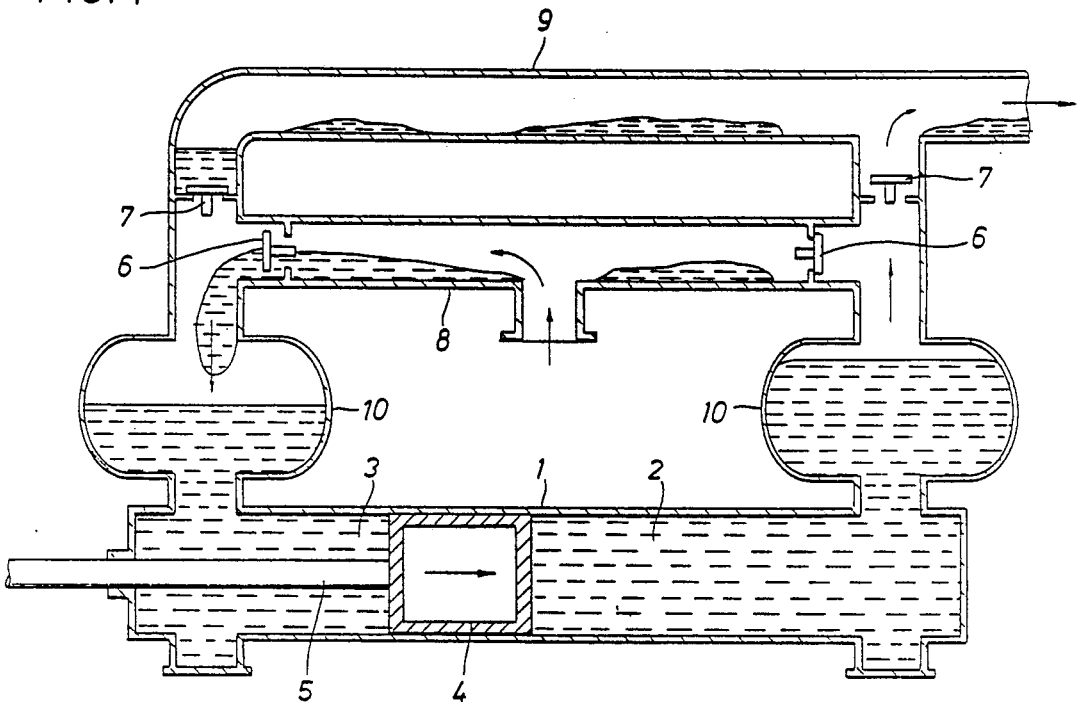
FIG. 4 is a cross-sectional view of the preferred embodiment of the invention illustrating fluid flow inside the pump.
Figure 5:
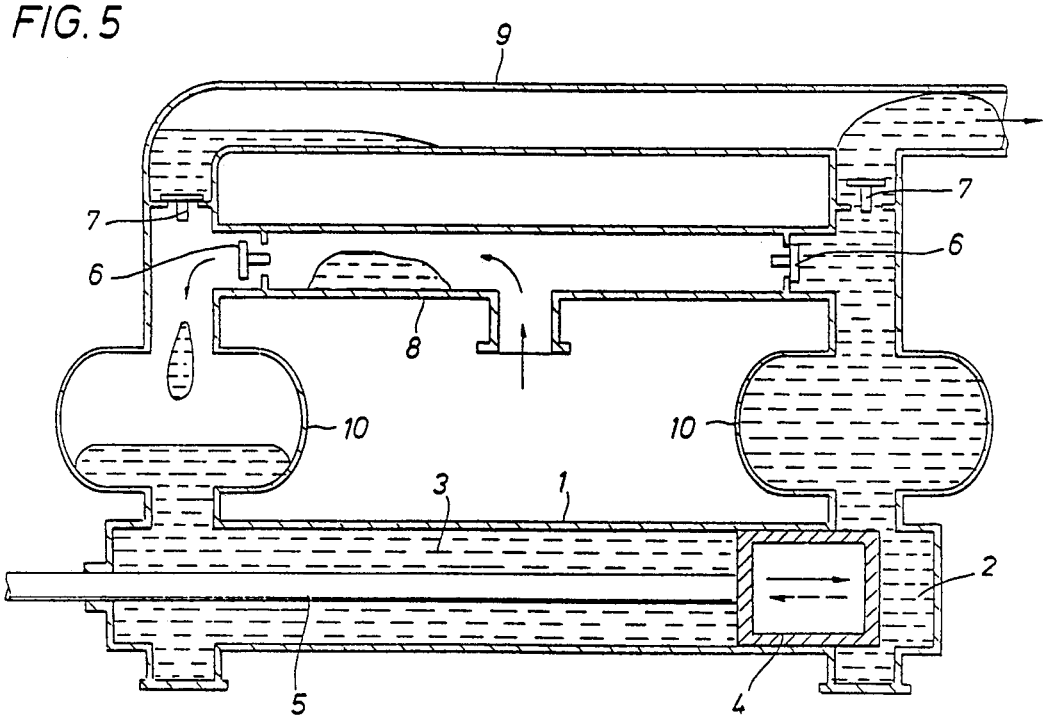
FIG. 5 is another cross-sectional view of the preferred embodiment of the invention illustrating fluid flow inside the pump.

The operation of the preferred embodiment of the invention, FIGS. 4 and 5, is similar to that of FIG. 2. When the piston reciprocates toward one end of the housing, the accumulator in communication with the chamber at that end of the housing will receive the liquid the piston forces out of the chamber (FIG. 4). As the piston moves to the other end of the housing, the volume of the chamber in the direction of the piston movement will decrease, while the volume of the other chamber increases. As a chamber's volume increases, the pressure in that chamber and accumlator decreases to the suction pressure allowing the fluid in the accumulator to enter the chamber and fluid from the source to enter the accumulator through the inlet check valve 6 and occupy the volume of the accumulator vacated by the liquid that entered the pump chamber. While the fluid is in the accumulator, gravitational forces will cause its gas components to rise above its liquid components allowing the liquid to enter the chamber before any gases. This separates the components of the fluids and helps prevent gases from entering the chamber.

While one chamber is increasing in volume allowing fluid to enter into its accumulator and that chamber, the volume of the other chamber is decreasing. When the chamber volume decreases, the pressure in the accumulator and chamber increases to the discharge pressure. Liquid is forced back into the accumulator from the chamber and the fluid in the accumulator is forced through the outlet check valve 7 and is discharged through the outlet manifold 9 into the outlet flowline. Because of the separation of the fluid components, gas will be discharged before the liquid. When the piston reaches the end of its stroke, the accumulator nearest the piston will be predominantly filled with liquid from the chamber in communication with it (FIG. 5). The other chamber will still be filled with liquid, while the accumulator volume will be occupied by fluids which entered the pump during the stroke.

When the piston changes direction, the same procedure occurs in the opposite direction. The procedure is repeated every time the motion of the piston changes direction.

The fluid inside the housing 1 is preferably the liquid component of the fluid being pumped. However, any suitable liquid may be used and should be at least the same density and weight of the liquid component of the fluid being pumped. The liquid for the chambers may be supplied by maintaining the liquid phase in the housing or by introducing a different liquid into the housing. In either case, the liquid in the housing may be viewed as an extension of the piston that pumps the multiphase fluid into the accumulators through the pipeline.

In this embodiment the piston always remains completely submerged in liquid, enabling the pump to achieve a higher efficiency from its pumping stroke. In some cases, when the piston reaches the end of a piston stroke, a certain clearance volume of gas, remains in the chamber. This compressed gas must expand to allow the pressure in the chamber to drop to the suction pressure (pressure at which fluid can enter the chamber) before any multiphase fluid enters the chamber. Once the gas has expanded and the pressure in the chamber is at the suction pressure, fluid enters the chamber. However, as the gas expands, it shortens the effective stroke of the piston. The first part of the piston stroke is used up by the gas expansion instead of allowing fluid to enter the chamber. By having all liquid in the housing, at the end of the piston stroke, the clearance volume will be entirely filled with liquid. Because the liquid is virtually incompressible, the pressure in the chamber will drop to the suction pressure as soon as the piston begins the intake stroke (moves in the opposite direction) and the effective stroke length is not affected by a clearance volume of gas.

Figure 10:
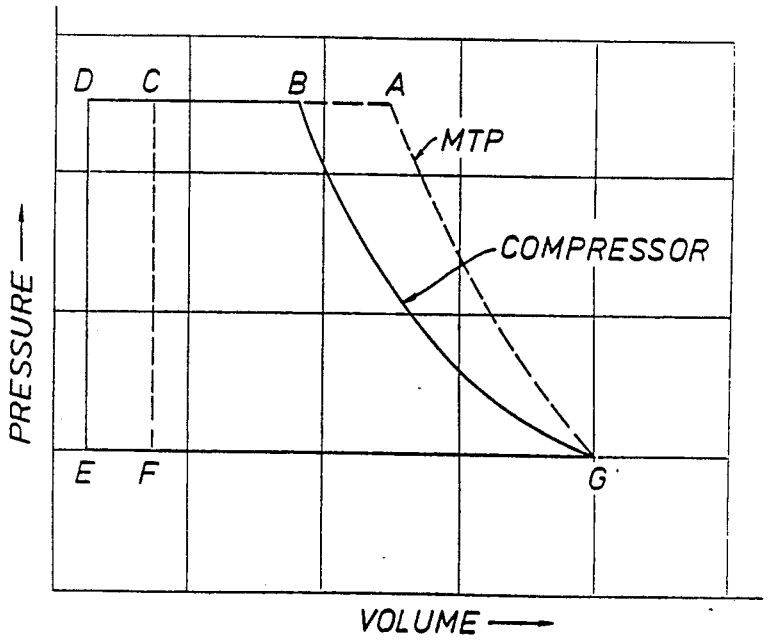
FIG. 10 is a diagram of the affects of compressing gases versus compressing liquid/gas mixtures.

The indicator card on FIG. 10 shows the affect of adding liquid to a compressor versus compressing 100% gas. Curve BDEG represents a compressor pumping 100% gas with zero clearance and curve ADEG represents the compression/pumping of liquid and gas. Portion ABCFG represents the gas volume while area CDEF represents the liquid in the chamber.

The amount of leakage or slippage between the piston and the housing is reduced by using the accumulator design. The accumulator ensures that the piston is always submerged in a liquid. Because slippage is inversely proportional to the fluid viscosity, and the viscosity of gases is much less than the viscosity of liquids, the amount of slippage is reduced by having the piston submerged in a liquid instead of being in contact with gas.

Figure 6:
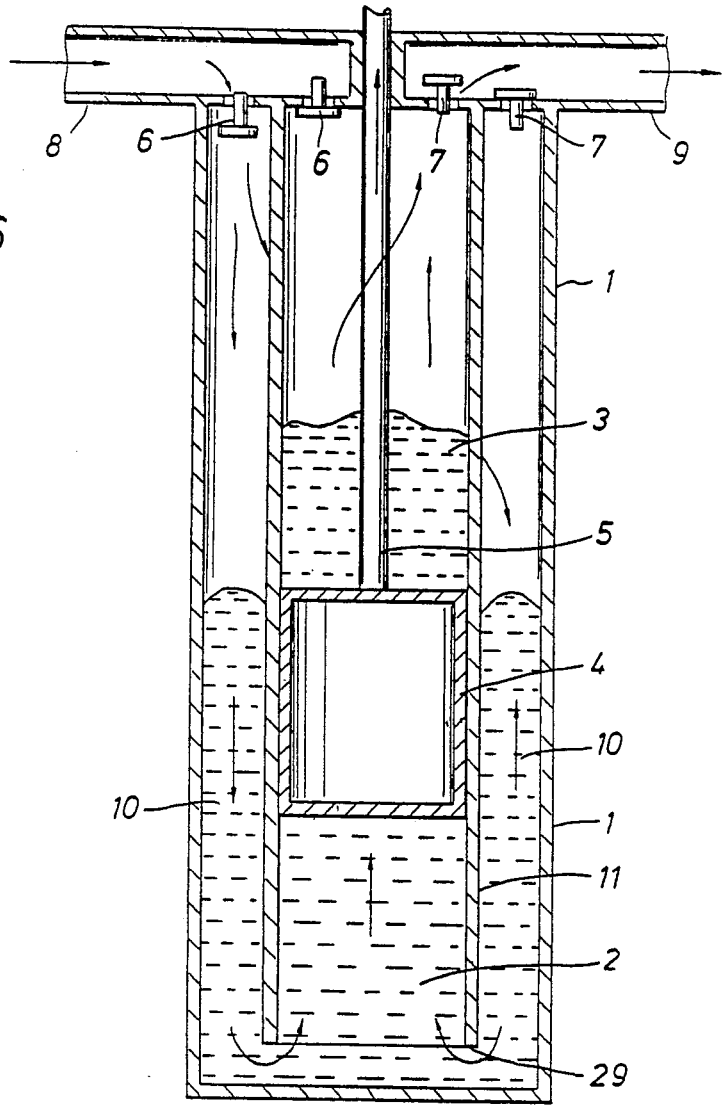
FIG. 6 is a cross-sectional view of a vertical embodiment of the invention.

A third embodiment is illustrated in FIG. 6. This pump has a vertical housing 1 with a sealed lower end. The barrel 11 has a longitudinally extended opening therein and is mounted inside the housing by any suitable means. The barrel has an open lower end 29 that extends downwardly in the housing 1. There is a clearance between the housing and the barrel that defines an annular accumulator volume 10 surrounding the barrel 11. The upper ends of the barrel 11 and the housing 1 are sealed by any suitable means except for a plurality of inlet and outlet openings found therethrough. A piston 4 divides the barrel into an upper chamber 3 and lower chamber 2. The piston rod sealingly extends through the upper end of the housing and is adapted to be reciprocated with respect to the housing. The accumulator volume 10 allows gravity to separate the fluids into their components. The volume of this accumulator space should be at least the maximum volume of the lower chamber. Inside the barrel a piston 4 is connected to a piston rod 5 to reciprocate the piston in the barrel. An inlet manifold 8 is attached to the upper end of the housing and barrel. The inlet manifold includes two check valves 6 which allow fluid to separately enter the upper chamber 3 and the accumulator volume 10 from the source. An outlet manifold 9 is attached to the upper end of the housing and barrel 11. The outlet manifold 9 includes two check valves 7 which allow fluid to exit the upper chamber 3 and the accumulator clearance 10 into a flowline.

As the piston 4 moves in an upward direction, the volume of the lower chamber increases, causing that chamber's pressure to decrease below the suction pressure thereby drawing fluid through the inlet valve 6 between the inlet manifold and the accumulator volume 10. The fluid drawn into the pump through the inlet valve 6 is contained in the accumulator space 10 where it separates. The liquid in the accumulator volume 10 is drawn down around the end of the barrel 11 and into the lower chamber 2.

As the piston moves in a downward direction it reduces the volume in the lower chamber 2, forcing the liquid out of that chamber and into the accumulator volume 10. This causes the pressure inside the accumulator volume 10 to increase, opening the outlet valve 7 between the accumulator volume 10 and the outlet manifold 9 and discharging the fluid inside the accumulator through the valve 7 and outlet manifold 9.

During the down stroke of the piston, the volume in the upper chamber 3 increases and the pressure decreases. The decrease in pressure permits the discharge valve 7 in communication with that chamber to close and the inlet valve 6 in communication with that chamber to open, drawing in fluid. Because the liquid is heavier than the gas, the liquid will accumulate directly above the piston in this chamber.

When the piston has reached its maximum downward position, the liquid contained in the lower chamber has now been displaced to the accumulator space and forced the fluid which had been contained in the accumulator space through the discharge valve and the outlet manifold. The volume just above the piston is now occupied with liquid and gas that has entered the upper chamber through an inlet valve. This design, as in the horizontal accumulator design, ensures that the piston is surrounded by liquid thus increasing the pump efficiency and reducing leakage and slippage.

A difference between the vertical embodiment and the horizontal embodiment is that in the vertical design an accumulator volume 10 is only required for the chamber 2 below the piston, since the liquid in the upper chamber 3 will accumulate just above the piston ensuring that the plunger is always in contact with a liquid.

Figure 7:
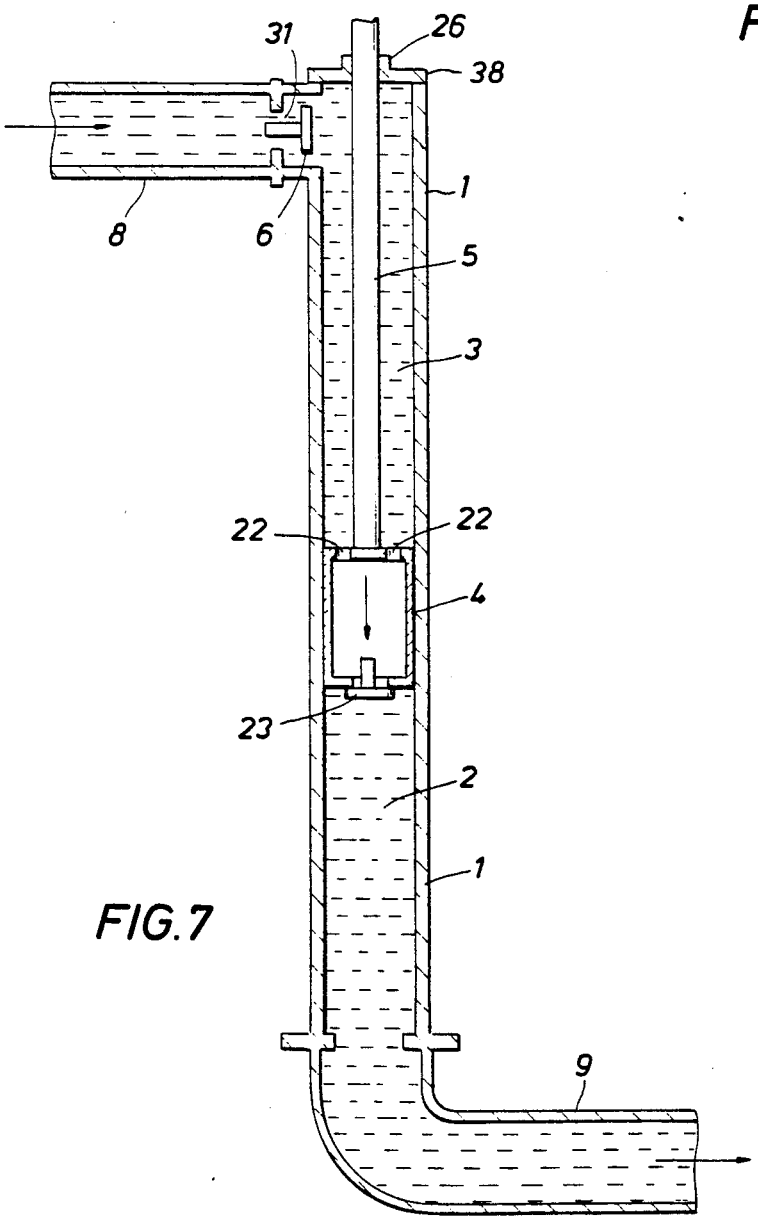
FIG. 7 is a cross-sectional view of a single-acting vertical embodiment of the present invention.

Another embodiment of this invention is the single acting vertical pump of FIG. 7. This design is most applicable in situations which involve the pumping of viscous fluids that have poor flowing properties. The pump has a housing 1 with a generally vertical longitudinal bore therein. A piston 4 is mounted for reciprocation in the housing. A piston rod 5 is attached to the piston and is connected to a suitable mechanism for reciprocating the piston. The top of the housing is sealed by a plate 38 attached to the end of housing by a suitable means and with an opening 26 therethrough for the piston rod. Some type of suitable sealing means is provided between the piston rod 5 and the plate 21, such as O-rings. A check valve 23 is attached to the bottom of the piston to allow fluids to flow downward through the piston during the up stroke and to prevent reverse flow during the down stroke. The piston also has holes 22 through its top side to permit fluid flow through the piston. An opening 31 is provided in the housing 1 at the top of the housing to allow fluids to enter the cylinder. An inlet manifold 8 is sealing connected to the housing in communication with the opening 31 to supply fluids to be pumped. A check valve 6 is sealingly mounted between the inlet manifold 8 and opening 31 to allow fluids to enter the housing and prevent backflow into the manifold 8.

During the operation of this design (FIG. 7), as the piston starts downward past the housing opening 31, the volume in the upper chamber increases and the pressure in that chamber decreases. As the pressure decreases below the pressure of the multiphase fluid in the inlet, the valve 6 will open and allow fluid to enter the housing. As the piston moves downward, it forces any fluid in the housing below the piston out through the outlet manifold 9. After the piston completes its downward motion it begins an upward motion. As the piston moves upward, the pressure in the upper chamber increases, thereby closing the inlet valve 6. Fluid that entered the housing above the piston flows through the piston holes 22 and piston valve 23 into the lower chamber. The fluid that flows through the piston during its upward motion is pumped out of the housing and through the outlet manifold during the next downward stroke of the piston.

Figure 8:
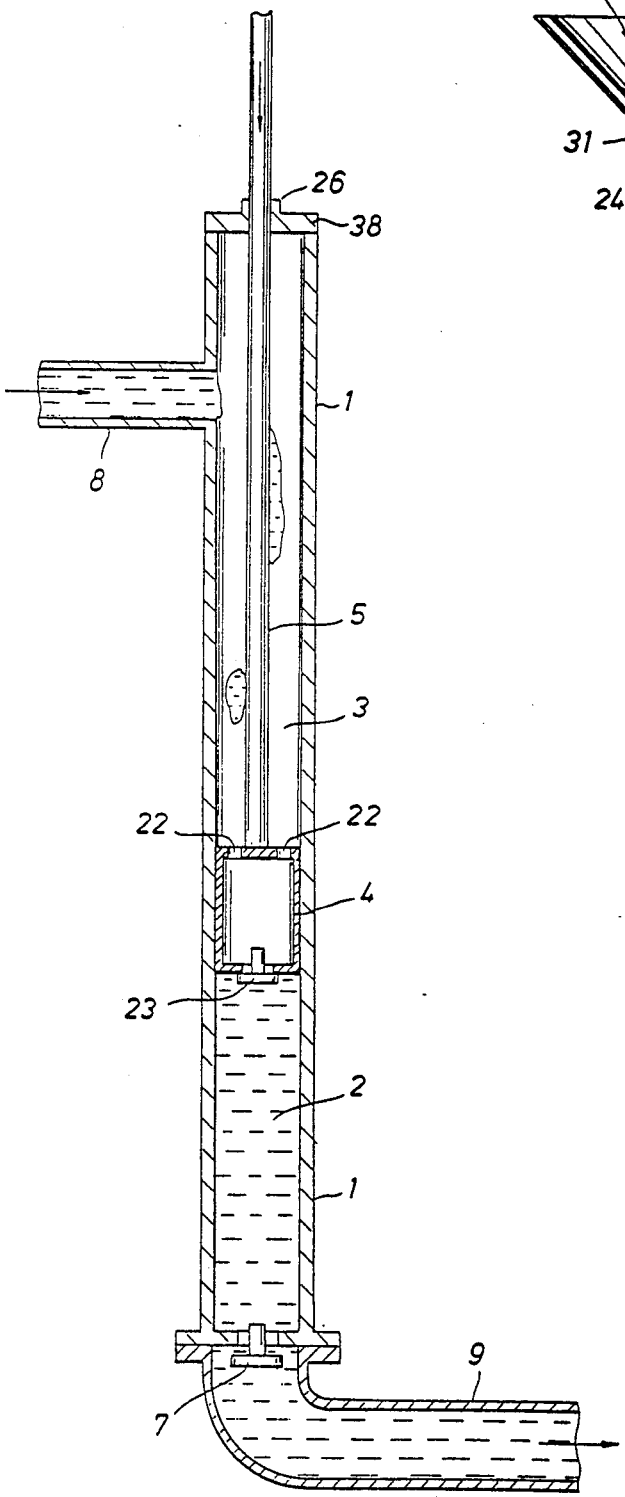
FIG. 8 is a cross-sectional view of a second single-acting vertical embodiment of the present invention.

The operation of the embodiment in FIG. 8 is similar to that in FIG. 7, however, in FIG. 8 an outlet check valve 7 is mounted to the bottom outlet of the housing. When the piston moves downward, the pressure in the lower chamber increases, opening the valve and forcing fluid out through the outlet manifold.

Figure 9:
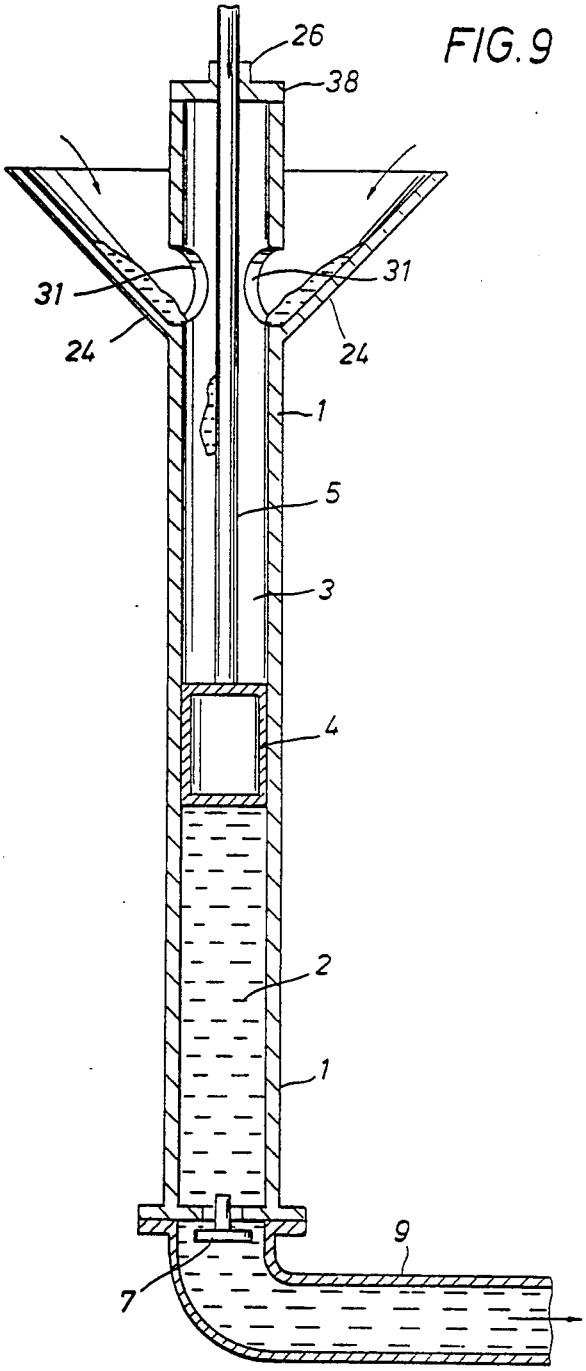
FIG. 9 is a cross-sectional view of a third single-acting vertical embodiment of the present invention.

A third embodiment, FIG. 9, of this design includes a hopper 24 connected to the housing 1 as a feeder for the inlet opening 31. Openings 31 are provided on both sides of the housing 1 to allow fluid to enter from either side. A check valve 7 is sealingly mounted at the bottom of the housing to allow fluids to exit the housing. Although not shown in FIG. 9, the piston should have openings in its top and a check valve in its bottom to allow fluids to flow through the piston during the upward movement as shown in FIGS. 7 and 8.

During the operation of the hopper embodiment, the inlet fluid initially enters the hopper 24 where it accumulates. Once in the hopper, the inlet fluid will start to flow or fall into the pump housing. While the housing is filling with fluid, the piston remains in its fully upward position. Once the housing is nearly full of incoming fluid, the piston moves downward displacing the fluid through a check valve into the discharge line (FIG. 9). The movement of the piston can be controlled in various ways such as: 1) a timer can activate the drive system moving the piston at periodic time intervals; or 2) a very slow piston speed can be used to allow the fluid to flow into the housing before pumping it into the outlet pipeline.

Once the piston has discharged the product, it returns to the fillage position above the hopper. The discharge valve will close and the procedure is repeated. During the piston's movement up the housing, fluid in the housing above the piston is forced either back into the hopper 24 or through holes in the top of the piston and a check valve at the bottom of the piston into the housing to be pumped during the next downward motion of the piston.

Although the method described above involves the use of a hopper to hold the product, the same process is possible without the use of a hopper as shown in FIG. 8. In addition, these vertical pump embodiments can be implemented with the cylinder in a horizontal position as well as a vertical position.

The multiphase fluid mass transfer pump of the present invention has been described in connection with its preferred embodiments. However, it is not limited thereto. Many changes and modifications to the basic design will be obvious to those skilled in the art having the benefit of the foregoing teachings. All such changes and modifications are intended to be within the scope of the invention which is limited only by the following claims.

What I claim is:

1. An apparatus for pumping multiphase fluid from a source of such fluid and through a flow line which comprises:

a. a housing having a longitudinal bore therein, first and second ends and first and second openings therethrough adjacent the first and second ends respectively;

b. a piston sealingly mounted in the bore in the housing and adapted for reciprocating movement therein, defining a first chamber on the first end of the housing and a second chamber on the second end of the housing, wherein the first chamber is in fluid communication with the first opening through the housing and the second chamber is in fluid communication with the second opening through the housing;

c. a first accumulator in fluid communication with the first opening in the housing, and having an inlet adapted to be connected to the source of multiphase fluid and an outlet connected to the flowline;

d. a second accumulator in fluid communication with the second opening in the housing, and having an inlet adapted to be connected to the source of multiphase fluid and an outlet connected to the flowline;

e. a first inlet valve connected to the first accumulator between the inlet and the source of multiphase fluid;

f. a first outlet valve connected to the first accumulator between the outlet and the flowline;

g. a second inlet valve connected to the second accumulator between the inlet and the source of fluid; and h. a second outlet valve connected to the second accumulator between the outlet and the flowline, wherein the first and second inlet valves, the first and second outlet valves, and the first and second accumulators are located relative to the first and second chambers, such that multiphase fluid enters the first and second accumulators at a point located with respect to the first and second chambers that the multiphase fluid at least partially separates therein when the piston is reciprocating, whereby the chambers generally remain at least partially filled with liquid when the apparatus is operating to pump multiphase fluid.

2. The apparatus of claim 1, wherein the first and second accumulators are elevated with respect to the first and second chambers.

* * * * *